US006031330A

United States Patent [19]

Yoshida et al.

[11] Patent Number: 6,031,330

[45] Date of Patent: Feb. 29, 2000

[54] FLUORESCENT LAMP

[75] Inventors: Mitsunari Yoshida, Kanagawa-ken; Toshiyuki Terada, Tokyo; Tomonori Abe; Kazuaki Kawasaki, both of Kanagawa-ken, all of Japan

[73] Assignee: Stanley Electric Co., Ltd., Tokyo, Japan

[21] Appl. No.: 08/942,232

[22] Filed: Oct. 1, 1997

[30] Foreign Application Priority Data

Mar. 14, 1997 [JP] Japan ..... 9-060931

[51] Int. Cl.[7] ..... H01J 65/04

[52] U.S. Cl. ..... 313/607; 313/234; 313/594; 313/573

[58] Field of Search ..... 313/607, 234, 313/594, 493, 572, 573, 635, 643

[56] References Cited

U.S. PATENT DOCUMENTS 4,645,979 2/1987 Chow ..... 313/607 X
4,887,002 12/1989 Dobashi et al. ..... 313/594 X
5,030,894 7/1991 Yoshiike et al. ..... 313/607 X
5,117,160 5/1992 Konda et al. ..... 313/607 X

FOREIGN PATENT DOCUMENTS 3225745 10/1991 Japan .

*Primary Examiner*—Ashok Patel
*Attorney, Agent, or Firm*—Weingarten, Schurgin, Gagnebin & Hayes LLP

[57] ABSTRACT

There is provided a fluorescent lamp comprising a tubular glass bulb, an internal electrode provided at the center of the tubular glass bulb, a fluorescent layer formed on an inner surface of the tubular bulb, and an external electrode provided on an outer surface of the tubular glass bulb, said tubular glass bulb being charged with a rare gas containing xenon as a main ingredient, wherein the charged pressure of the rare gas is 100 to 300 torr, the inner diameter of the tubular glass bulb is 4 to 12 mm and the thickness of the tubular glass bulb is 0.4 to 1.2 mm. As a result, lighting voltage is greatly reduced, whereby the charged pressure of the rare gas can be increased, thereby making it possible to improve illuminance.

2 Claims, 3 Drawing Sheets

FLUORESCENT LAMP

BACKGROUND OF THE INVENTION

1. Field of the Invention

This invention relates to a fluorescent lamp and, more specifically, to a fluorescent lamp used as a back light source for liquid crystal displays used as a display for portable computers or a reading light source for facsimiles.

2. Background Art

An example of this type of fluorescent lamp of the prior art is, as shown by laid-open Japanese Patent Application No. Hei 3-225745, a rare gas discharge lamp (fluorescent lamp) in which a fluorescent layer is formed on the inner surface of a tubular glass bulb, the tubular glass bulb is charged with a rare gas and a pair of belt-shaped electrodes are formed on almost the total length of the outer surface of the glass bulb.

However, in the fluorescent lamp of the prior art described above, lighting voltage is high. Since lighting voltage increases as the pressure of the rare gas charged into the glass bulb rises, the pressure of the charged gas is limited to 100 torr or less to make it practical lighting voltage as disclosed in the above publication. As a result, illuminance sufficiently high to meet an application purpose cannot be obtained.

SUMMARY OF THE INVENTION

An object of the present invention for solving the above problem of the prior art is to provide a fluorescent lamp comprising a tubular glass bulb, an internal electrode provided at the center of the tubular glass bulb, a fluorescent layer formed on an inner surface of the tubular bulb, and an external electrode provided on an outer surface of the tubular glass bulb, said tubular glass bulb being charged with a rare gas containing xenon as a main ingredient, wherein the charged pressure of the rare gas is 100 to 300 torr, the inner diameter of the tubular glass bulb is 4 to 12 mm and the thickness of the tubular glass bulb is 0.4 to 1.2 mm.

Another object of the present invention is to provide a fluorescent lamp as above in which the charged pressure of the rare gas is 150 to 250 torr.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
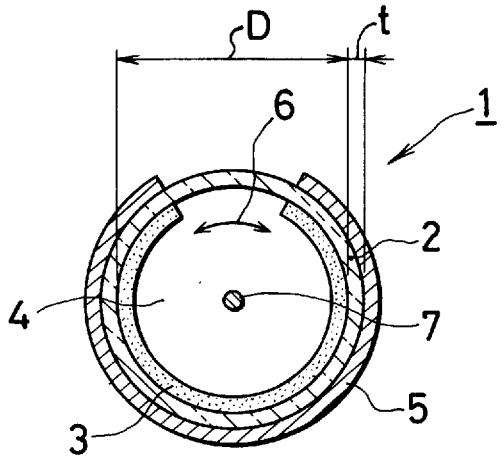
FIG. 1 is a sectional view of a fluorescent lamp according to an embodiment of the present invention.

The present invention is described in detail hereinafter with reference to embodiments shown in the accompanying drawings. FIG. 1 is a sectional view of a fluorescent lamp 1 according to the present invention. The fluorescent lamp 1 comprises a tubular glass bulb 2 and a fluorescent layer 3 formed on the inner surface of the tubular glass bulb 2, in which a rare gas 4 containing xenon (Xe) as a main ingredient is charged, like the prior art.

In addition to this, also in the present invention, an external electrode 5 is provided on the outer surface of the glass bulb 2. Although a pair of the external electrodes 5 are not provided unlike the prior art, only one electrode having an opening portion 6 in an axial direction of the glass bulb 2 is provided on the outer surface of the glass bulb 2 and an internal electrode 7 as the other electrode is provided inside the glass bulb 2.

With the above configuration, it has been confirmed by the results of manufacture and experiments for carrying out the present invention by the inventors of the present invention that lighting voltage can be reduced to 50 to 60% of that of a fluorescent lamp of the prior art having a pair of external electrodes under the same conditions such as the size of the glass bulb and the type of the charged gas or the like.

Representing an example of the above experimental results by specific values, a lighting voltage of 1,100 Vrms was required at a lamp current of 20 mA when the charged pressure of the rare gas was 60 torr in the constitution of the prior art. On the other hand, a lighting voltage of 620 Vrms was required at a lamp current of 20 mA even when the charged pressure of the rare gas was 250 torr in the constitution of the present intention. Thus, the lighting voltage of the present invention can be reduced to approximately 56% of that of the prior art.

That the above charged pressure can be increased to a high level means that the amount of light can be increased. Compared with a tube wall brightness of 9,000 nt in the prior art, a tube wall brightness in the fluorescent lamp 1 of the present invention is 13,000 nt which is approximately 44% higher than that of the prior art. Since lighting voltage (power) is reduced to 56% as described above at this point, efficiency is improved to 4 times or more that of the prior art as a whole.

Figure 2:
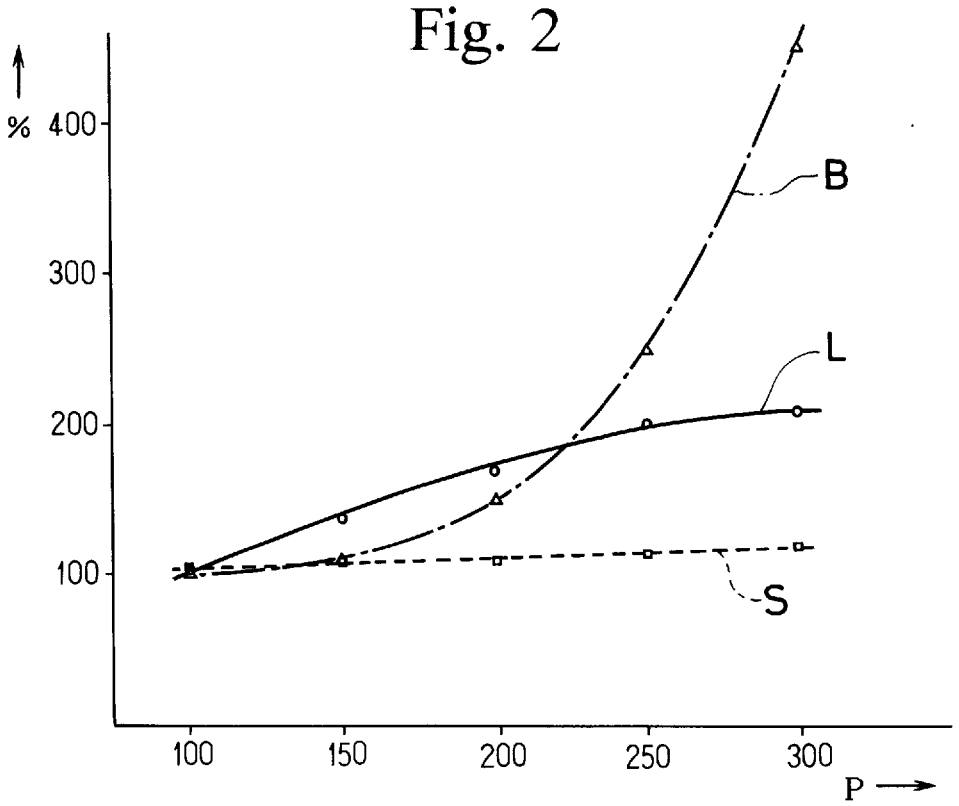
FIG. 2 is a graph showing the relationship between illuminance, flickering and changes in the amount of light, and the charged pressure of a rare gas in the above embodiment of the present invention.

In addition to the above feature, in the present invention the charged pressure P of the rare gas 4 and the inner diameter D and thickness t of the glass bulb 2 are limited. The graph of FIG. 2 shows the results of experiments made to find the optimum conditions by changing the charged pressure P under the same conditions. In the graph, L designates illuminance, B designates flickering, and S designates changes in the amount of light, where they are expressed as relative values when they are 100 at a charged pressure P of 100 torr.

It is clearly seen from FIG. 2 that when the charged pressure P is within the range of 100 to 300 torr, illuminance L improves as the charged pressure P increases. However, when the charged pressure P is between 250 and 300 torr, the degree of improvement in illuminance L slows down. Therefore, as a not so large effect cannot be obtained by further increasing the charged pressure P, the preferred range of charged pressure P is limited to 100 to 300 torr in the present invention.

Reviewing FIG. 2 in more detail, since it is seen that flickering B sharply increases at a charged pressure P of 300 torr and not so much improvement in illuminance cannot be expected as compared with the prior art at a charged pressure P of 100 torr, the rare gas is preferably charged at 150 to 250 torr.

Figure 3:
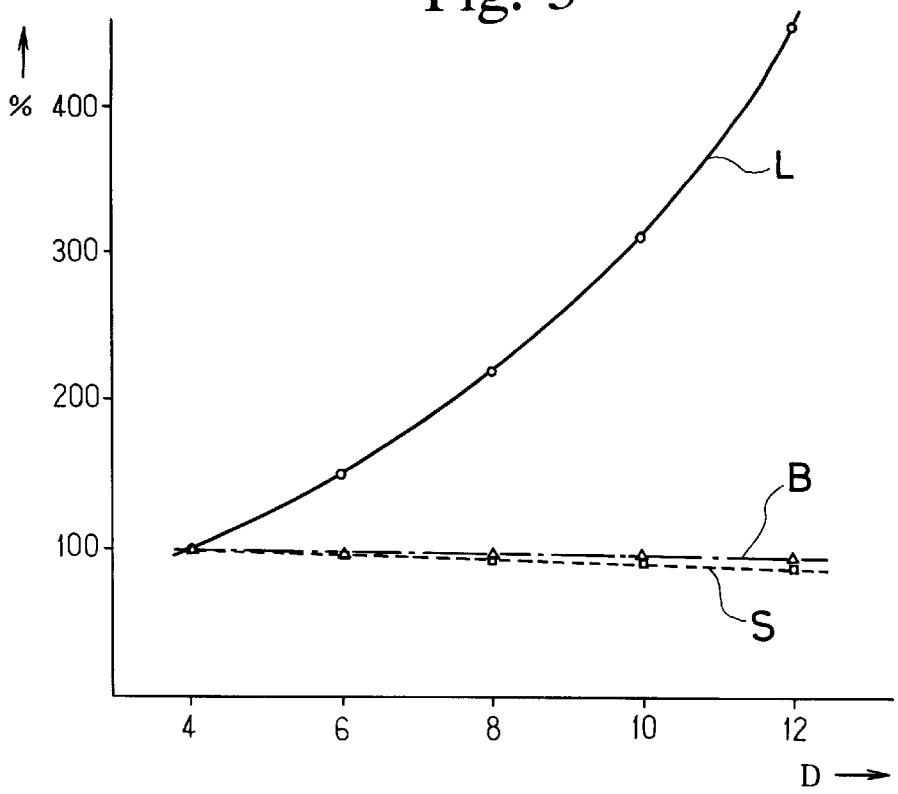
FIG. 3 is a graph showing the relationship between illuminance, flickering and changes in the amount of light, and the inner diameter of a glass bulb in the above embodiment of the present invention.

The graph of FIG. 3 shows results obtained by changing the inner diameter D of the glass bulb when the charged pressure P was set to 250 torr and the thickness t of the glass bulb 2 was fixed at 0.8 mm. It is obvious from this graph that illuminance L is improved and flickering B and a change in the amount of light S are reduced by increasing the inner diameter D. In the graph, illuminance L, flickering B, and changes in the amount of light S are expressed as relative values when they are 100 at an inner diameter of 4 mm.

When the inner diameter D is less than 4 mm, it is extremely difficult to install the internal electrode 7, operational ease deteriorates and yield lowers, thereby reducing productivity. When the inner diameter D is more than 12 mm, the fluorescent lamp 1 becomes too large in size for its application. Therefore, the inner diameter D is limited to the range of 4 to 12 mm in the present invention.

Figure 4:
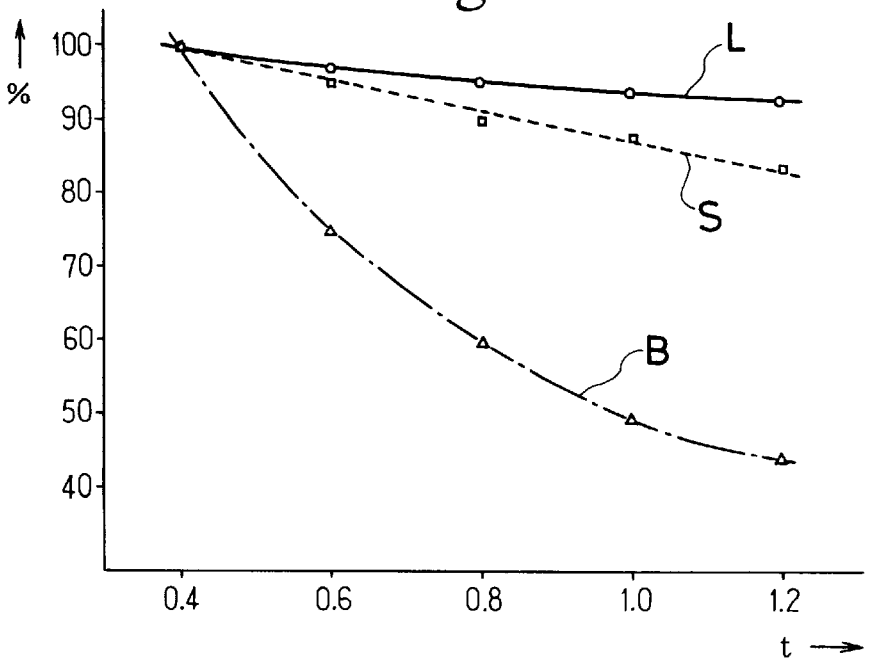
FIG. 4 is a graph showing the relationship between illuminance, flickering and changes in the amount of light, and the thickness of the glass bulb in the above embodiment of the present invention.

The graph of FIG. 4 shows results obtained by changing the thickness t of the glass bulb 2 when the charged pressure P was set to 250 torr and the inner diameter D of the glass bulb 2 was fixed at 8 mm. It is obvious from this graph that illuminance L is slightly lowered but flicking B is significantly reduced by increasing the thickness t. In this graph, illuminance L, flickering B, and changes in the amount of light S are expressed as relative values when they are 100 at a thickness t of 0.4 mm.

When the thickness t is less than 0.4 mm, flicking B becomes significant and when the thickness t is more than 1.2 mm, operational ease when the glass bulb 2 is charged is greatly impaired and yield lowers at the same time, thereby reducing productivity. Therefore, in the present invention, the thickness t is limited to the range of 0.4 to 1.2 mm.

Figure 5:
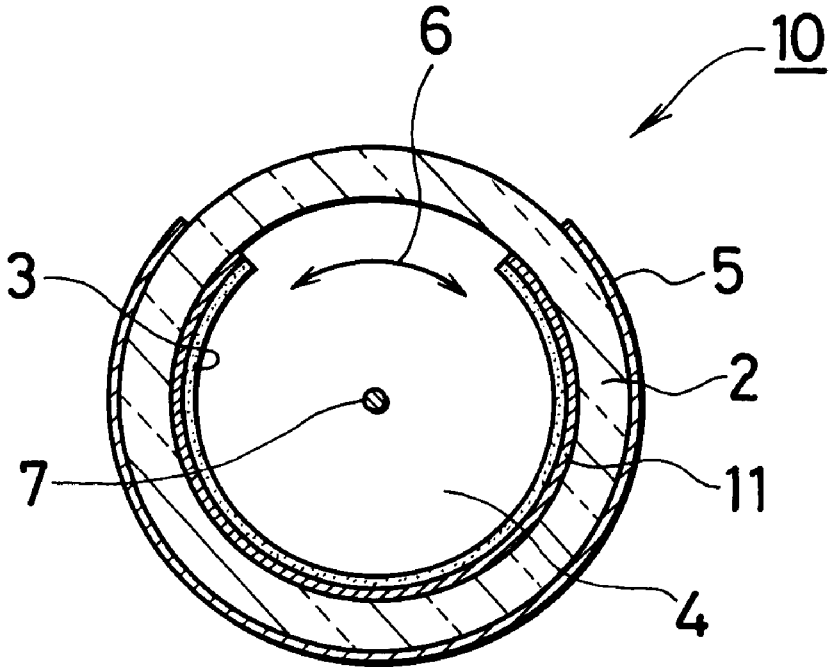
FIG. 5 is a sectional view of a fluorescent lamp according to another embodiment of the present invention.

FIG. 5 shows a fluorescent lamp 10 according to another embodiment of the present invention. In the fluorescent lamp 1 of the previous embodiment, the external electrode 5 is formed using, for example, a metal lustrous color or white color conductive coating to reflect light emitted from the fluorescent layer 3 toward the glass bulb 2.

In this embodiment, a reflection layer 11 is formed from, for example, titanium oxide ($TiO_2$) on the inner surface of the glass bulb 2 in advance and the fluorescent layer 3 is formed on the inner surface of the reflection layer 11. The present invention can be carried out on this fluorescent lamp 10 in completely the same manner and the obtained function and effect are totally the same as in the above embodiment.

As described above, in the fluorescent lamp of the present invention comprising an external electrode provided on the outer surface of a tubular glass bulb, an internal electrode provided at the center of the glass bulb, and a fluorescent layer formed on the inner surface of the glass bulb, in which a rare gas containing xenon as a main ingredient is charged, the charged pressure of the rare gas is set to 100 to 300 torr, the inner diameter of the glass bulb is set to 4 to 12 mm and the thickness of the glass bulb is set to 0.4 to 1.2 mm. As a result, lighting voltage is greatly reduced, whereby charged pressure can be increased as compared with that of the prior art, thereby making it possible to improve illuminance. Therefore, the present invention can provide such an extremely excellent effect that the performance of this type of fluorescent lamp is improved. By specifying the thickness and inner diameter of the glass bulb, an increase in flickering caused by improvement in illuminance can be suppressed, thereby making it possible to further improve the performance of the fluorescent lamp.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A fluorescent lamp comprising a tubular glass bulb, an internal electrode provided at the center of the tubular glass bulb, a florescent layer formed on an inner surface of the tubular bulb, and an external electrode provided on an outer surface of the tubular glass bulb, said tubular glass bulb being charged with a rare gas containing xenon as a main ingredient, wherein the charged pressure of the rare gas is 100 to 300 torr, the inner diameter of the tubular glass bulb is 0.4 to 12 mm and the thickness of the tubular glass bulb is 0.4 to 1.2 mm, and wherein the external electrode has a width greater than one half the circumference of the tubular glass bulb.

2. A fluorescent lamp comprising a tubular glass bulb, an internal electrode provided at the center of the tubular glass bulb, a florescent layer formed on an inner surface of the tubular bulb, and an external electrode provided on an outer surface of the tubular glass bulb, said tubular glass bulb being charged with a rare gas containing xenon as a main ingredient, wherein the charged pressure of the rare gas is 100 to 300 torr, the inner diameter of the tubular glass bulb is 0.4 to 12 mm, and the thickness of the tubular glass bulb is 0.4 to 1.2 mm, wherein the charged pressure of the rare gas is greater than 160 torr and less than or equal to 300 torr, and wherein the external electrode has a width greater than one half the circumference of the tubular glass bulb.

* * * * *